United States Patent [19]

Strickland et al.

[11] Patent Number: 4,519,570

[45] Date of Patent: May 28, 1985

[54] INSIDE CORNER CONCRETE FORM UNIT

[75] Inventors: James K. Strickland; H. Grady Ivey, both of Jacksonville, Fla.

[73] Assignee: Strickland Systems, Inc., Jacksonville, Fla.

[21] Appl. No.: 534,682

[22] Filed: Sep. 22, 1983

[51] Int. Cl.[3] ..... B28B 7/30

[52] U.S. Cl. ..... 249/194; 249/27; 249/180; 249/185; 249/219 R

[58] Field of Search ..... 249/27, 63, 178, 180, 249/184, 185, 194, 219 R

[56] References Cited

U.S. PATENT DOCUMENTS

| | | | |
|---|---|---|---|
| 2,827,683 | 3/1958 | Benart et al. | 249/180 |
| 3,353,782 | 11/1967 | Zastrow | 249/152 |
| 3,680,824 | 8/1972 | Kesting | 249/13 |
| 3,822,853 | 7/1974 | Shelley | 249/27 |
| 3,853,452 | 12/1974 | Delmonte | 249/27 |
| 4,252,292 | 2/1981 | Armas | 249/184 |
| 4,447,035 | 5/1984 | Ivey et al. | 249/194 |

*Primary Examiner*—Jay H. Woo
*Assistant Examiner*—James C. Housel
*Attorney, Agent, or Firm*—Banner, Birch, McKie & Beckett

[57] ABSTRACT

A form unit to cast the inside surfaces of a corner of a concrete structure has a pair of form panels disposed generally perpendicular to each other and an elongated corner member disposed between the adjoining edges of such panels with an actuator having relatively movable parts including a first part connected by parallelogram linkage to each of the form panels and a second part connected to the corner member so that when the actuator parts are moved together the form panels are butted against the outer edges of the corner member and when the actuator parts are moved apart the form panels are separated from the corner member. Holding means retains the corner member against displacement toward the panels while the form panels are being stripped from the hardened concrete and latch means holds the form panels against relative movement while the corner member is being stripped. The latch means and holding means are operated conjointly and in conjunction with operation of the actuator, preferably all operations being performed hydraulically. For casting all inside surfaces of a complete tubular structure four of the corner form units are assembled into a box configuration with the outwardly facing walls defining the inside surfaces of the structure to be cast.

7 Claims, 6 Drawing Figures

INSIDE CORNER CONCRETE FORM UNIT

BACKGROUND OF THE INVENTION

The invention relates generally to concrete form work and more particularly to improvements in apparatus that can be effectively automated to cast the inside surfaces of a corner as may be required in forming a tubular concrete structure such as an elevator shaft, box culvert, etc.

The prior art contains many different proposals for concrete form work and its assembly, manually or with some degree of automation, into functional units for concrete construction. Accordingly, various structures have been suggested to facilitate the positioning of concrete form panels as required in the casting of an inside corner forming a part of a concrete wall structure. The forming of such inside corners is concrete casting necessarily arises in the construction of concrete shafts for elevators and stairwells as well as in other concrete structures such as box culverts.

In the casting of inside corners for structures as mentioned above, it is an important objective that the surface be smooth and free from joint lines once the form panels and associated components are stripped from the hardened cast concrete. Still, it is important that the apparatus utilized to cast the concrete inside corner be as simple in construction as possible involving a minimum number of structural elements, certainly avoiding the necessity for use of a variety of detached or detachable elements which would be subject to becoming separated or lost from the overall apparatus thereby preventing reuse of the apparatus at a multiplicity of different site locations.

In large measure, the prior art has been unable to achieve the desired attributes of providing a unitized apparatus which can be automatically operated effectively in the casting of inside surfaces of a concrete corner, both in setting up the form panels and related components preliminarily to concrete pouring and in stripping the panels and components from the subsequently hardened concrete.

Accordingly, one of the principal objects of this invention is the provision of a form unit to cast the inside surfaces of a corner of a tubular concrete structure which will yield smooth inner surfaces at and adjacent the inside corner with the unit being subject to automatic set up and stripping of the form panels and components against which the concrete is poured.

Another essential object of the invention is the provision of a unitized concrete form unit for inside corner casting which is self contained such that manipulation of the elements making up the form unit may be carried out automatically, basically without independent support for any of the components making up the inside corner form unit.

A further object of the instant invention is to provide an inside corner form unit which is totally automated and easily subject to being operated hydraulically, solely in response to flow control of a pressurized hydraulic fluid.

An additional object of this invention is to provide an inside corner forming unit wherein automated operation enables the unit to be set up for initial concrete pouring followed by first stripping form panels disposed adjacent the inside corner which has been cast followed by stripping a corner member from the cast inside corner while the previously stripped form panels are held against relative movement to each other.

SUMMARY OF THE INVENTION

Briefly the invention involves a unitized concrete form unit for inside corner casting such as required in the construction of various tubular concrete structures. The apparatus employs a pair of form panels disposed generally perpendicular to each other with their casting surfaces facing outwardly and an elongated corner member extending parallel to these forms panels and disposed generally between adjoining edges of such panels. An axially extensible actuator providing relatively movable first and second parts has its first part interconnected to each form panel by a parallelogram linkage having respective collapsed and expanded conditions. The second part of such actuator is connected to move the corner member.

Holding means cooperates between the corner member and the form panels to retain the corner member against displacement toward the form panels while the parallelogram linkage means is shifted to its expanded condition by the actuator, this shifting serving to strip the panels from the hardened concrete. In addition, latch means is provided to hold the form panels against relative movement while the actuator is operated to strip the corner member.

Operating means is provided on the concrete form unit to operate both the holding means to and from its retaining condition and the latch mean to and from its holding condition. Preferably the actuator and operating means are energized through utilization of a pressurized hydraulic fluid, with the latch means and holding means being operated conjointly.

Where the simultaneous casting of all inside surfaces of a tubular concrete structure is desired, four of the concrete form units are assembled into a box configuration, with or without utilization of supplemental form panels intermediate adjacent inside corner form units such that the outwardly facing walls of this box configuration will define the inside surfaces of the tubular concrete structure that is to be cast.

BRIEF DESCRIPTION OF THE DRAWINGS

The foregoing objects as well as others, will become apparent through consideration of the following detailed description of the invention given in connection with the accompanying illustrations on the drawings in which.

DETAILED DESCRIPTION OF AN ILLUSTRATIVE EMBODIMENT

Figure 1:
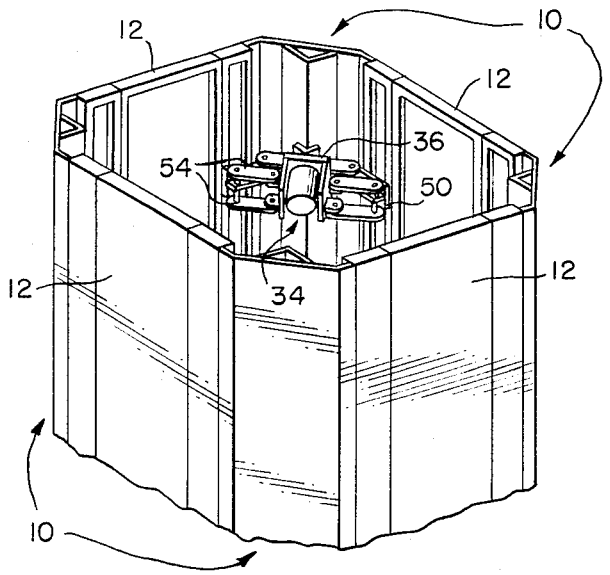
FIG. 1 is a partial diagramatic perspective view showing four inside corner form units assembled with intermediate form panels about which a tubular concrete structure would be cast.

FIG. 1 shows four inside corner form units 10 of the instant invention assembled by being bolted together with four intermediate form panels 12 into a box configuration. This box configuration assembly with its outwardly facing wall would define the inside surfaces of a tubular concrete structure, such as a box culvert, when concrete is poured therearound. Obviously, exterior form panels (not shown) will be suitably mounted, spaced outwardly of the box configuration walls, to establish the concrete wall thickness for the tubular concrete structure.

It will be readily recognized that the dimensions of the assembled box configuration may be easily varied depending upon the particular dimensions of the tubular concrete structure that is to be cast. For example, two or all of the intermediate form panels 12 may be omitted. With omission of intermediate panels 12, the four form units 10 would simply have their adjoining edges bolted directly together. Likewise it will be recognized that the width dimensions of intermediate form panels 12 may be varied as desired to generate the desired dimensions for the assembled box configuration needed for the tubular concrete structure to be cast.

It will of course be understood that the particular external shape, size or wall thickness of the tubular concrete structure that is cast will be determined by the particular form panels (not shown) as they are mounted and secured spaced outwardly of the outwardly facing walls of the assembled box configuration of FIG. 1. It also should be mentioned that the particular construction of the individual form panels themselves may take a variety of forms in accordance with more or less conventional practices in the concrete form work art. The manner in which each form panel is constructed is not deemed a part of the instant invention.

Simply by way of illustration, and in no way limiting on the invention, it may be mentioned that each inside corner form unit 10, as well as the associated intermediate form panels 12 if such are employed, may be constructed to have an 8 foot length with a form unit 10 width of 18 inches extending from the corner. Obviously, longer or shorter lengths and/or widths for the form units 10 may be adopted depending on the needs for the particular tubular concrete structure to be cast.

In adopting this 8 foot length for the form units 10, it has been found appropriate to utilize similar assemblies of actuator, parallelogram linkages, holding means, latch means and related parts, adjacent both the upper and lower ends of each form unit 10. Taking this approach, a single hydraulic cylinder operator connected to a single operating rod may expeditiously be used to effect the operation of both the holding means and latch means. This overall adaptation of the invention to an 8 foot long form unit 10 may be best visualized by observing the broken halves displayed on each of FIGS. 4 and 5 for one form unit 10.

Figure 2:
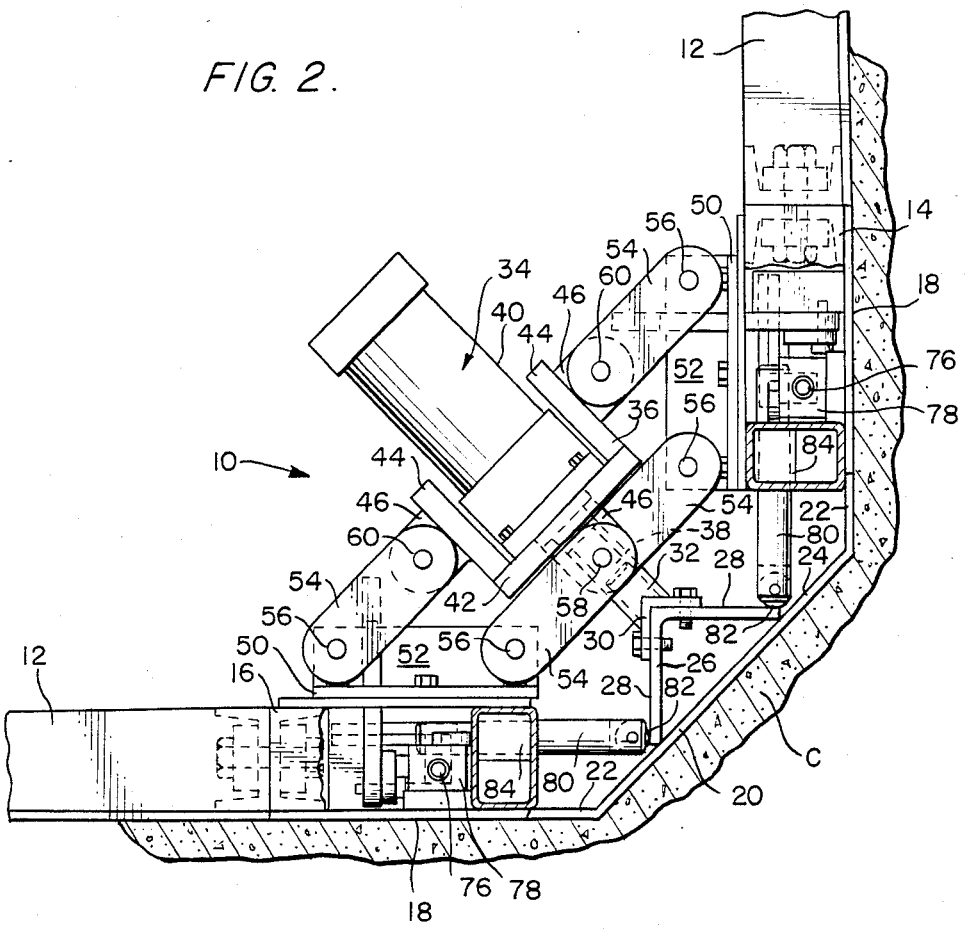
FIG. 2 is a plan view partially in section showing the inside corner form unit with segments of adjacent intermediate panels and a segment of concrete cast on the exterior faces thereof.
Figure 3:
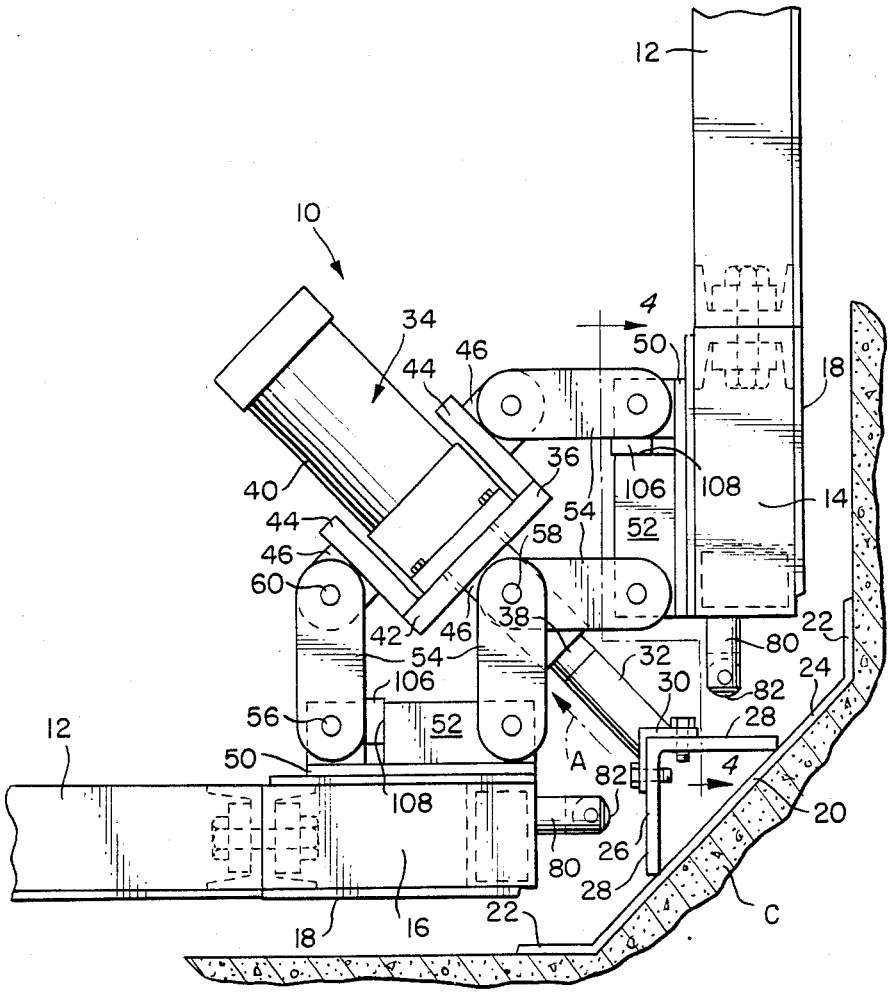
FIG. 3 is a view similar to FIG. 2, but showing the inside corner form unit after the form panels have been stripped from the hardened concrete but with the corner member of such unit still in place.

The activating components for each inside corner form unit 10 may best be understood by reference to FIGS. 2 and 3. However, FIG. 1 does illustrate, in perspective, one assemblage of these components supported on the interior of the assembled box configuration shown on FIG. 1.

Each form unit 10 has a pair of form panels 14 and 16 disposed generally perpendicular to each other. The outwardly facing walls 18 of these panels define the faces against which the concrete C is cast. An elongated corner member 20 is disposed generally between the adjoining edges of form panels 14 and 16 with the outwardly facing walls of corner member 20 defining the face against which concrete C is cast at the location intermediate the outwardly facing walls 18 of panels 14 and 16.

In the configuration illustrated on the drawings, the corner member 20 has a cross-section defined by edge flanges 23 joined by a center section 24 that extends diagonally between the flanges 22. It will be readily understood that the cross-sectional configuration of corner member 20 is not limited to this form, but may take the shape of a right angle in cross-section or such other configuration as may be desired depending upon the desires for the inside surfaces of the corner of the tubular concrete structure that is to be cast.

Elongated corner member 20, as best seen on FIGS. 2 and 3, has a strengthening angle 26 appropriately welded to the interior face thereof. Angle 26 provides inwardly facing guide surfaces 28 which function with the holding means for the form unit 10 in a manner which will be described subsequently.

A bracket 30 is suitably bolted at the external corner of angle 26. A drive sleeve 32 is fixed to bracket 30 as by appropriate welding so that the axis of sleeve 32 extends diagonally inwardly at a 45 degree angle relative to the perpendicular relationship between the pair of form panels 14 and 16. With the assembly as specifically shown on FIGS. 2 and 3, the drive sleeve 32 projects inwardly normal to the center section 24 of corner member 20.

The primary actuator for the form unit 10 which provides the power to strip form panels 14 and 16 followed by stripping corner member 20 from the hardened concrete C is provided by a hydraulic cylinder actuator 34 having its cylinder 40 bolted to a body assembly 36 and its piston rod 38 extending through the base 42 of the assembly 36 and threaded into the drive sleeve 32 such that relative movement between the cylinder 40 and rod 38 parts of the hydraulic cylinder actuator 34 will carry out the desired movements of the corner member 20 in a manner as will be described.

Again as best seen on FIGS. 2 and 3, the cylinder 40 of hydraulic actuator 34 is appropriately bolted to the base 42 of body assembly 36 with the piston rod 38 of such actuator 34 projecting through the base of body assembly 36 and threaded into the drive sleeve 32 to be fixedly secured to carry the corner member 20 through the intermediary of bracket 30 and angle 26 welded to corner member 20.

The body assembly 36 carrying hydraulic cylinder actuator 34 includes base 42 to which the cylinder 40 is secured and through which the piston rod 38 extends to its connection with drive sleeve 32. Spaced flanges 44 are appropriately welded along the sides of base 42 to give the body assembly 36 a generally U-shaped configuration with flanges 44 extending along the sides of cylinder 40 of hydraulic actuator 34.

Pairs of laterally spaced ears 46 are welded to extend outwardly of each of the flanges 44. A similar pair of ears 46 is welded to extend from base 42 of assembly 36 toward corner member 20, with the ears 46 making up this latter pair being spaced on opposite sides of and lying parallel to piston rod 38 and drive sleeve 32.

The inwardly facing surface of each of form panels 14 and 16 has a T bracket 50 bolted thereto such that each bracket 50 presents an upstanding central flange 52.

This flange 52 is suitably drilled and reamed to provide pivot mounting bores adjacent each of its ends.

Pairs of spaced, parallel control links 54 are pivotally connected by pins 56 of these bores adjacent the ends of flanges 52 of brackets 50 with these control links extending inwardly toward the body assembly 36. The inner ends of the two pairs of control links 54 that are closest to the corner member 20 have their ends pivotally connected by pins 58 to the pair of spaced ears 46 which are carried by the base 42 of assembly 36. Similarly the inner ends of the pairs of control links 54 that are remote from the corner member 20 have their ends pivotally connected by pins 60 to the pairs of spaced ears 46 which are secured to and extend outwardly from the sides of flanges 44 of body assembly 36.

The above described structure consisting of body assembly 36 coupled to the T brackets 50 by control links 54 forms a parallelogram linkage at each side of the hydraulic cylinder actuator 34. This pair of parallelogram linkages assures positive accurate controlled movement of the form panels 14 and 16 when actuator 34 has its cylinder 40 and piston rod 38 parts moved from their contracted position shown in FIG. 2 where the parallelogram linkages are collapsed to their extended position as shown in FIG. 3 where the parallelogram linkages are expanded. The structure of the parallelogram linkages may also be visualized from their showing on FIG. 1.

In the showing of FIG. 2, the cylinder and piston rod parts 40 and 38 of hydraulic cylinder actuator 34 are in their contracted position with the parallelogram linkages including control links 54 in collapsed condition. In this state, the form panels 14 and 16 are butted against the outer edges of the flanges 22 of corner member 20. The inside corner form unit is thus in condition for pouring and thus casting concrete C against its outer faces.

As shown on FIG. 3, the cylinder and piston rod parts 40 and 38 of hydraulic cylinder actuator 34 are extended. In this state the parallelogram linkages including control links 54 are in their expanded condition with both form panels 14 and 16 having been stripped from the hardened concrete C while corner member 20 remains in place against the surfaces of concrete C which it has formed. Indeed, the force necessary to strip form panels 14 and 16 by extending the hydraulic cylinder actuator 34 has been directly applied to concrete C by force applied through piston rod 38, drive sleeve 32, bracket 30 and angle 26 which is welded to corner member 20.

Thereafter, to strip the corner member 20 from the hardened concrete C, the hydraulic cylinder actuator 32 is contracted resulting in its cylinder and piston rod parts 40 and 38, respectively, moving together. In doing this the piston rod 38, drive sleeve 32, bracket 30, angle 26 and corner member 20 are pulled in the direction of arrow A shown on FIG. 3.

To assure that the form panels 14 and 16, and corner member 20 properly move together to set up for casting concrete C as shown on FIG. 2 with the form panels butted against the outer edges of the corner member 20 and, even more importantly, insure that the form panels 14 and 16 are moved relative to corner member 20 to be stripped as shown in FIG. 3 and thereafter that corner member 20 can be stripped without the form panels 14 and 16 undergoing relative movement, the inside corner form unit is provided with two operating mechanisms which will now be described.

One mechanism act as a holding means to cooperate between the corner member 20 and the form panels 14 and 16 to retain corner member 20 against displacement toward the form panels while the parallelogram linkages are shifted between their expanded and collapsed conditions. The second mechanism is in the form of a latch means which serves to hold the form panels 14 and 16 against relative movement while the hydraulic cylinder actuator 34 is contracted to strip the corner member 20 from the hardened concrete C.

Each of the holding and latch means referred to above has operating means effective to operate the holding means to and from a retaining condition and likewise operate the latch means to and from its holding condition. In the preferred embodiment illustrated, a single operator 70, in the form of an axially extensible hydraulic cylinder, is provided for the mechanisms of each of form panels 14 and 16. Operator 70 is appropriately affixed to the form panel with which it is associated as by being bolted thereto as is shown in the upper halves of FIGS. 4 and 5.

The piston rod 72 of operator 70 is connected by coupling 74 to an operating rod 76. Rod 76 is slidable in appropriate bearings 78 mounted on the form panel 14 or 16 in which it is supported to extend longitudinally of the form panel and longitudinally of corner member 20 of form unit 10. Reciprocating movements of operating rod 76 transmitted thereto by the extension and contraction of the hydraulic cylinder operator 70 are utilized to conjointly operate the mechanisms making up the holding means and latch means for the inside corner form unit 10 as will now be described.

The mechanism forming the holding means which is to retain the corner member 20 against displacement toward either of form panels 14 and 16 while such panels are being stripped from the hardened concrete C includes a distance rod 80. Each distance rod 80 is mounted in a tubular bearing 84 mounted in the side wall of the form panel 14 or 16 which faces the guide surfaces 28 of angle 26 carried by corner member 20. This bearing 84 supports the distance rod 80 so as to be axially reciprocable in the general plane of the form panel in which it is mounted.

The outer end of each distance rod 80 carries a roller 82 with its axis of rotation lying generally parallel to the length of the corner member 20. The tubular bearing 84, mounted in the form panels 14 or 16 to slidably receive the distance rod 80, guides the axial reciprocation of rod 80 such that in its extended position as shown on FIG. 2 the roller 82 carried by rod 80 is capable of rolling along the guide surface 28 provided on the exterior of angle 26 of corner member 20. Similarly, when withdrawn to the position as shown on FIG. 3 the distance rods 80 and their rollers 82 are substantially spaced from the surfaces 28 of angle 26.

Before describing the operating linkage to extend and retract the distance rods 80, their function as the holding means mechanism may be explained. With the form unit 10 components in their relationship shown on FIG. 2 and after the concrete C has been poured and hardened, the action of stripping the form panels 14 and 16 is to be carried out. At this stage the distance rods 80 are locked in their extended positions with their rollers 82 engaging the surfaces 28 of angle 26 carried by corner member 20. Then, by directing pressurized hydraulic fluid to the forward end of cylinder 40 of the hydraulic cylinder actuator 34, the actuator parts are extended during which time the parallelogram linkages at the sides of actuator 34 are shifted from their collapsed condition shown on FIG. 2 to their expanded condition shown on FIG. 3. During this shifting action the rollers 82 of distance rods 80 will roll along the guide surfaces 28 of angle 26 while the fixed extended length of these distance rods will assure that the corner member 20 is retained against displacement toward either form panel 14 or 16.

Similarly, when it is desired to again set up the inside corner form unit 10 by returning the components to their relationship as shown on FIG. 2, the actuator 34 can be extended by directing pressurized hydraulic fluid into the rear of its cylinder 40. Then the distance rods 80 will be extended until their rollers 82 engage the guide surfaces 28 of the angle 26 affixed to corner member 20.

Thereafter, the actuator 34 can be contracted by introducing pressurized hydraulic fluid to the end of cylinder 40 that is affixed to base 42 of body assembly 36. This will tend to shift the parallelogram linkages from their expanded condition as shown in FIG. 3 back to their collapsed condition as shown in FIG. 2. However, the extended distance rods 80 will assure that the corner unit 20 is not simply drawn back by the contraction of actuator 34, but rather that the spacial distance between surfaces 28 and the respective edges of form panels 14 and 16 is maintained by the distance rods 80 being held in their extended position.

The distance rods 80 are extended and retracted through linkage means connecting them to be operated by the reciprocating motions of operating rod 76 as it is controlled by the hydraulic cylinder operator 70. This linkage may best be understood by viewing FIGS. 4 and 6 on the drawings.

Each distance rod 80 is provided with a longitudinally extending slot 86 adjacent the end thereof opposite its roller 82. In the form specifically illustrated, bearing pins 88 are mounted to extend centrally across the top and bottom of slot 86, these pins serving to provide more precise force applying points for the forces required to extend and hold the distance rod 80 in its retaining condition, and to retract the distance rod 80.

A bell crank 90 is pivotally supported on a pin carried by block 92, this block being appropriately affixed to be carried by the form panel. One arm of bell crank 90 engages within the slot 86 of distance rod 80 in a manner such that the upper and lower edges thereof will drivingly engage with one or the other of the bearing pins 88 where they extend across slot 86, depending upon whether the distance rod 80 is being extended or retracted. The other leg of bell crank 90 is pivotally connected by pin 94 to link 96.

The opposite end of link 96 is pivotally connected to connector 98 which may be fixedly pinned to operating rod 76 at the appropriate location such that connector 98 partakes of the reciprocating movements of operating rod 76 under the driving force applied thereto by hydraulic cylinder operator 70.

Figure 4:
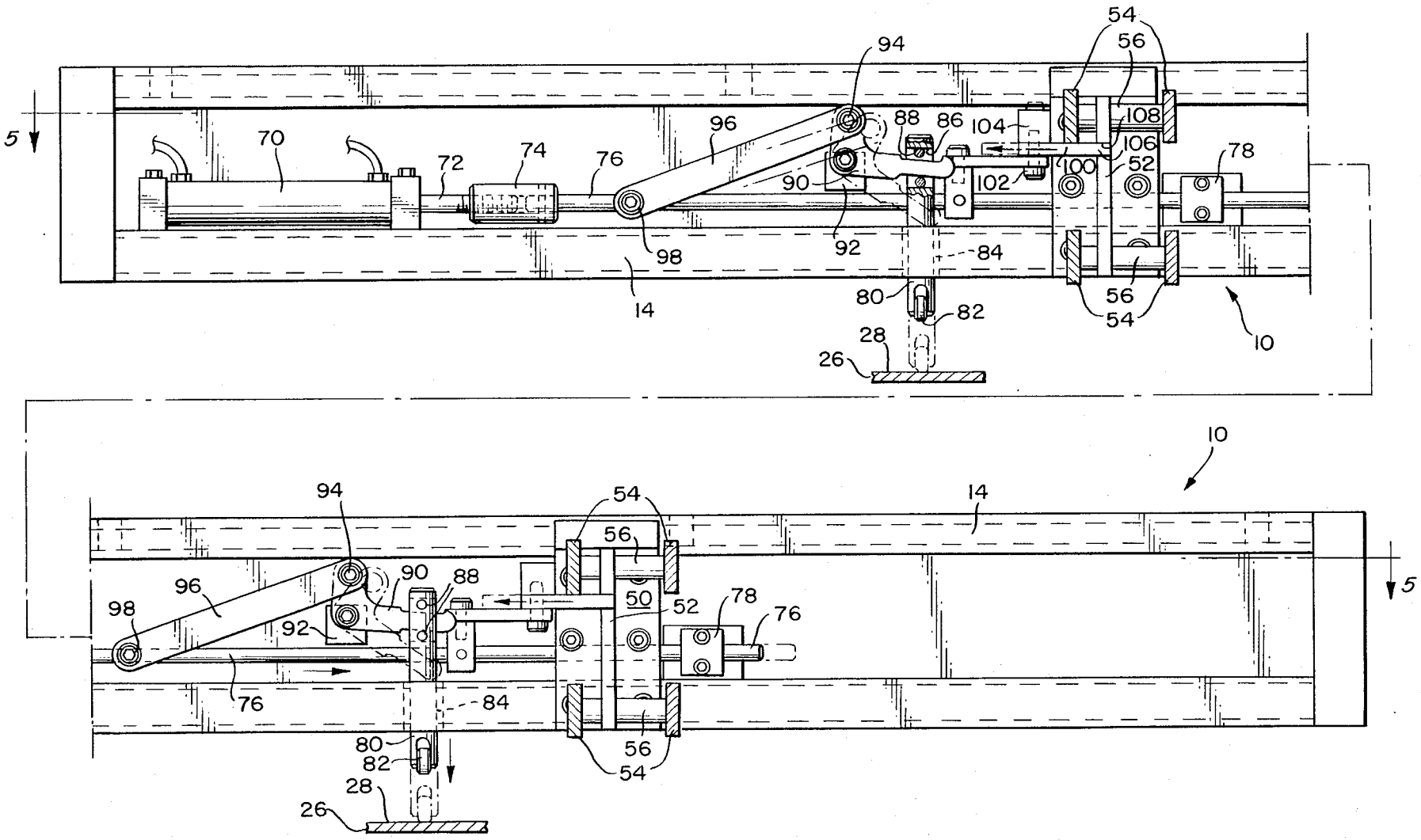
FIG. 4 is a broken side elevation of the inside corner form unit taken on line 4—4 of FIG. 3.
Figure 5:
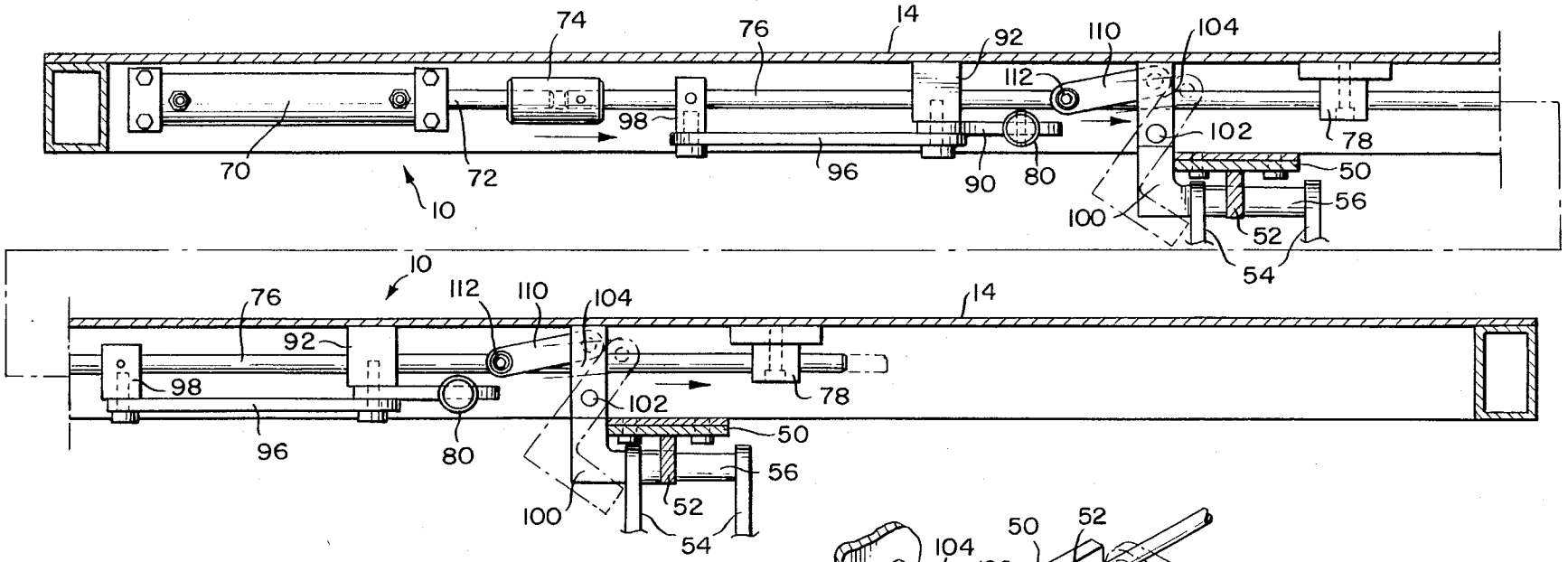
FIG. 5 is a broken sectional view taken on line 5—5 of FIG. 4.
Figure 6:
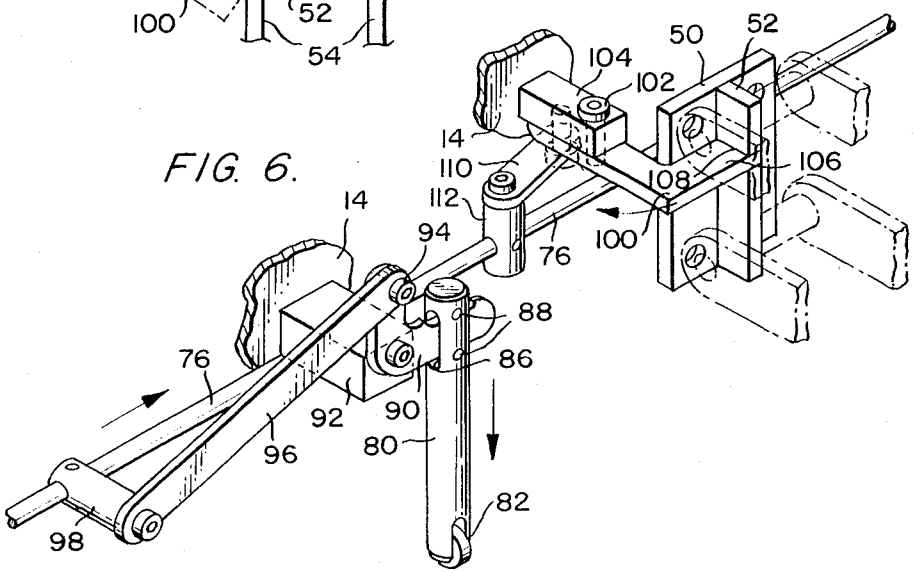
FIG. 6 is a partial perspective view of the operating mechanisms for the holding and latching means for the form unit.

Through the above linkage connecting each distance rod 80 to operating rod 76 it will be understood that when operator 70 is hydraulically extended by application of pressurized hydraulic fluid to the rear end thereof, the operating rod 76 will move to the right as shown in FIGS. 4–6 resulting in the linkage extending the distance rods 80. Similarly when operator 70 is contracted by hydraulic fluid pressure applied to the piston rod 72 end, operating rod 76 will move to the left, resulting in link 96 and bell crank 90 causing distance rod 80 to retract.

The mechanism providing the latch means serving to hold the form panels 14 and 16 against relative movement while the actuator 34 strips the corner member 20 may best be visualized by reference to FIGS. 5 and 6. In its holding condition the latch means cooperates with the parallelogram linkages while they are in their expanded condition as shown on FIG. 3 so as to prevent these linkages from shifting out of this expanded condition toward the collapsed condition as shown in FIG. 2.

The latch means is provided by an L-shaped latch 100 pivoted intermediate its ends on pin 102 which is carried by block 104 fixedly secured to the form panel 14 or 16 depending upon the particular panel being considered. The outer end 106 of L-shaped latch 100 is intended to engage within notch 108 formed in the longitudinal edge of flange 52 on T-shaped bracket 50.

Latch 100, as mounted to pivot on pin 102 for its outer end 106 to swing into engagement with notch 108 in flange 52 of T-bracket 50, is so positioned that the latch end 106 when engaged in notch 108 positions latch end 106 to pass closely along one edge of a control link 54 in the parallelogram linkage when such linkage is in its expanded condition as shown on FIG. 3. It will be apparent from FIG. 3 that this location of the latch end 106 relative to two of the control links 54 in the parallelogram linkages on opposite sides of actuator 34 carried by body assembly 36 will effectively hold the parallelogram linkages and consequently the form panels 14 and 16 carried thereby against relative movement irrespective of actuator 34 being extended and contracted to carry out movements of the corner member 20. Thus in this holding condition for the form panels 14 and 16 actuator 34 may be contracted under hydraulic power to strip the corner member 20 away from the hardened concrete C, moving it in the direction A as shown on FIG. 3.

The end of L-shaped latch 100 opposite its outer end 106 is connected by link 110 to connector 112 with connector 112 being fixedly pinned to operating rod 76. It will thus be appreciated that through the forces transmitted through link 110 to pivot latch 100 into its latched or holding condition with respect to the parallelogram linkage by reason of movements of operating rod 76 to which connector 112 is fixed, the operator 70 by its extension and contraction will effectively move latch 100 to and from its holding condition.

Having described both of the mechanisms for the holding means that retain the corner member against displacement toward the form panels and the latch means that holds the form panels against relative movement while the corner member 20 is being stripped, the particular conjoint operation of these mechanisms by the operator 70 acting in reciprocating operating rod 76 is important. When operator 70 is extended, driving operating rod 76 to the right as shown in FIGS. 4–6 the distance rods 80 will be extended and conjointly the latches 100 will be pivoted out of their holding condition. Likewise, when operator 70 is contracted, drawing operating rod 76 to the left as shown in FIGS. 4–6, the distance rods 80 will be retracted while conjointly the latches 100 will be pivoted into their holding condition relative to the parallelogram linkages carrying the form panels 14 and 16. Summarizing, the operator 70 is connected through operating rod 76 such that it operates the holding means provided by distance rods 80 to their retaining condition when the latch means provided by latches 100 are operated out of their holding condition. Conversely, operator 70 in its contracted position operates the latch means of latches 100 to their holding condition while the holding means of distance rods 80 is operated out of its retaining condition.

It has not been felt necessary to enter into description or illustration of specific hydraulic controls appropriate to effect the desired operations of hydraulic cylinder actuator 34 and/or hydraulic cylinder operator 70 in carrying out the above described movement or manipulation of the components of the inside corner form unit 10. These controls and appropriate valving of pressurized hydraulic fluid in hydraulic circuitry are known and can be appropriately designed by technology in the art.

It should be recognized that although utilization of hydraulic cylinder actuators and hydraulic power generally have desirable advantages in form unit 10, other forms of actuators and power sources to provide the operating means may be used within the scope of the invention as contemplated.

It should also be noted that whereas in the description and drawing illustrations the operating assemblies for the form panels 14 and 16, and corner member 20 have been shown duplicated at the upper and lower ends of the corner unit 10, only one or more than two of these assemblies may be employed depending upon the overall length contemplated for the inside corner form unit 10. Utilizing a single operator 70 for a plurality of these assemblies offers the particular advantage that conjoint operation of the holding means and latch means for all such assemblies can be achieved utilizing a single operating rod 76 located in each of the form panels 14 and 16.

Particular advantages for this inside corner form unit 10 of this invention will be recognized by reason of its essentially self-contained nature and capability for operation without independent support which could require a separate scaffold or other ground supporting frame work. With the automated and conjoint control of the holding means and latch means in relation to the pair of form panels 14 and 16, and elongated corner member 20, this self-contained nature of the form unit can be achieved.

The powerful forces available by extension and contration of the hydraulic cylinder actuator 34 are fully available to carry out the form stripping operation. The parallelogram linkages coupling the actuator 34 to each of the form panels 14 and 16 enables actuator 34 to simply apply pressure against the corner member 20 while it is stripping the panels 14 and 16 from the hardened concrete C. Then with the latches 100 shifted into their holding condition, the form panels 14 and 16 are prevented from shifting back toward the hardened concrete, but instead the parallelogram linkages as locked by the latches 100 enable the actuator 34 to be contracted by forces applied through its piston rod 38 to drive sleeve 32 whereby the corner member 20 is stripped from the hardened concrete C. Conjoint operation of the holding means and latch means permitted by the single operator 70 effectively coordinates the operation of the inside corner form unit 10 in carrying out these stripping operations.

It should be obvious from the above discussed apparatus embodiment that numerous other variations and modifications of the apparatus of this invention are possible and such will readily occur to those skilled in the art. Accordingly, the scope of this invention is not to be limited by the embodiment disclosed, but is to include any such embodiments as may be encompassed within the scope of the claims appended thereto.

What is claimed is:

1. A concrete form unit for inside corner casting comprises:

a pair of form panels disposed generally perpendicular to each other;

an elongated corner member disposed generally between adjoining edges of said panels;

actuator means having relatively moveable first and second parts interconnecting said panels and said corner member, said second part being connected to move said corner member;

parallelogram linkage means connecting each of said form panels to said first part of said actuator, said linkage means having respective collapsed and expanded conditions;

holding means having a retaining condition operable to cooperate between said corner member and said form panels to retain said corner member against displacement toward said panels while said linkage means is shifted to said expanded condition by said actuator to strip said panels from the hardened concrete;

latch means having a holding condition operable to hold said form panels against relative movement while said actuator strips said corner member; and operating means effective to operate said holding means to and from said retaining condition and operate said latch means to and from said holding condition, said operating means including an operator connected to conjointly operate said holding means and said latch means.

2. A concrete form unit as recited in claim 1 wherein said operator is connected to operate said holding means to said retaining condition when said latch means is operated out of said holding condition and to operate said latch means to said holding condition when said holding means is operated out of said retaining condition.

3. A concrete form unit as recited in claim 2 wherein said operator includes an axially extensible actuator.

4. A concrete form unit as recited in claim 3 wherein said actuator is provided by a hydraulic cylinder actuator.

5. A concrete form unit for inside corner casting comprises:

a pair of form panels disposed generally perpendicular to each other;

an elongated corner member disposed generally between adjoining edges of said panels;

actuator means having relatively moveable first and second parts interconnecting said panels and said corner member, said second part being connected to move said corner member;

parallelogram linkage means connecting each of said form panels to said first part of said actuator, said linkage means having respective collapsed and expanded conditions;

holding means having a retaining condition operable to cooperate between said corner member and said form panels to retain said corner member against displacement toward said panels while said linkage means is shifted to said expanded condition by said actuator to strip said panels from the hardened concrete, said holding means including distance rod means engageable between said corner member and at least one of said form panels to retain said corner member;

latch means having a holding condition operable to hold said form panels against relative movement while said actuator strips said corner member, said latch means including a shiftable latch cooperable with said linkage means in said holding condition of said latch means to hold such form panels against relative movement, said latch being pivotally mounted to engage within a notch formed in one link of said linkage means and hold said linkage means in said expanded condition; and operating means effective to operate said holding means to and from said retaining condition and operate said latch means to and from said holding condition.

6. A concrete form unit as recited in claim 13 wherein said rod means includes a rod carrying a roller at one end, said rod being mounted on one of said panels to axially reciprocate in the general plane of said one panel with said roller engaging with a surface provided on said corner member that is normal to said plane.

7. A concrete from unit for inside corner casting comprises:

a pair of form panels disposed generally perpendicular to each other;

an elongated corner member disposed generally between adjoining edges of said panels;

actuator means having relatively moveable first and second parts interconnecting said panels and said corner member, said second part being connected to move said corner member;

parallelogram linkage means connecting each of said form panels to said first part of said actuator, said linkage means having respective collapsed and expanded conditions;

holding means having a retaining condition operable to cooperate between said corner member and said form panels to retain said corner member against displacement toward said panels while said linkage means is shifted to said expanded condition by said actuator to strip said panels from the hardened concrete, said holding means including distance rod means engageable between said corner member and at least one of said form panels to retain said corner member;

latch means having a holding condition operable to hold said form panels against relative movement while said actuator strips said corner member, said latch means including a shiftable latch cooperable with said linkage means in said holding condition of said latch means to hold said form panels against relative movement; and operating means effective to operate said holding means to and from said retaining condition and operate said latch means to and from said holding condition, said operating means including an axially extensible operator and an operating rod extending longitudinally of said form panels and said corner member coupled to be reciprocated by said operator, said operating rod being connected to both said distance rod means and said shiftable latch to effect their operation.

* * * * *